US006565923B1

(12) United States Patent
Cheng

(10) Patent No.: US 6,565,923 B1
(45) Date of Patent: May 20, 2003

(54) METHOD FOR MANUFACTURING REINFORCED ORIENTED STRAND BOARD

(76) Inventor: Ying-Ming Cheng, No. 7, Alley 16, Lane 623, Kang Ning Street, Hsichih Chen, Taipei Hsien (TW)

( * ) Notice: Subject to any disclaimer, the term of this patent is extended or adjusted under 35 U.S.C. 154(b) by 0 days.

(21) Appl. No.: 09/650,414

(22) Filed: Aug. 29, 2000

(51) Int. Cl.[7] ..... B05D 3/12; B05D 7/08

(52) U.S. Cl. ..... 427/297; 427/296; 427/350; 427/351; 427/392; 427/393; 427/393.4; 427/396; 427/397

(58) Field of Search ..... 427/296, 297, 427/350, 351, 392, 393, 393.4, 396, 397

(56) References Cited

U.S. PATENT DOCUMENTS 3,968,276 A * 7/1976 Allen ..... 422/31
5,309,690 A * 5/1994 Symons ..... 428/116
5,679,407 A * 10/1997 Mansikkamaki et al. ... 427/297
5,756,571 A * 5/1998 Moore ..... 524/425
5,955,023 A * 9/1999 Ioffe et al. ..... 264/463
6,084,008 A * 7/2000 Liu ..... 523/179
6,235,346 B1 * 5/2001 Barnish, Jr. ..... 427/297
6,235,349 B1 * 5/2001 Grantham et al. ..... 427/397.8
6,277,482 B1 * 8/2001 Amundson et al. ..... 428/317.7

* cited by examiner

*Primary Examiner*—Shrive P. Beck
*Assistant Examiner*—Kirsten Crockford Jolley
(74) *Attorney, Agent, or Firm*—Rosenberg, Klein & Lee

(57) ABSTRACT

A method for manufacturing reinforced oriented strand boards includes steps of injecting melamine-formaldehyde resin or phenol-formaldehyde resin in finished oriented stand boards, of heating and pressing them to let the resin harden. As strands of woods of the originally oriented strand boards cannot completely closely bonded together, with many gaps remained, so injected resin can fill up those gaps and filtrate and wrap the strand woods to make the whole oriented strand boards having reinforced strength and fire-resistant property as well.

4 Claims, 3 Drawing Sheets

METHOD FOR MANUFACTURING REINFORCED ORIENTED STRAND BOARD

BACKGROUND OF THE INVENTION

This invention relates to a method for manufacturing reinforced oriented strand boards, particularly to one including steps of forcefully filling a kind of resin in an oriented strand board, fully filling gaps in the board to manufacture oriented strand boards having firm structural strength and fire-resistant characteristic.

The higher the living standard of people becomes, the more the demand of wooden material grows, but unfortunately natural forests grow very slowly. Although fast growing trees newly planted provide the lacking quantity of wooden material, trees planted are almost softwood having limited use, and they are impossible to substitute the hardwood used more widely than soft one. Therefore, human beings have been making efforts to develop artificial fabricated wood boards, such as veneers, fiber boards, strand boards, etc. so as to replace various natural wood boards. The important factors of artificial wood boards are hardness, durability, and stability, which can reach nearly the same as natural hard wood. Then additives may be added in adhesive or glue to make veneers, fiberboards for special purpose and use so as to improve their property, such as moisture-resistance, fire-resistance, erosion-resistance, and insect-resistance.

One of the artificial wood boards most similar to natural hard wood may be oriented strand boards called shortly as OSB (Layer-to-layer cross oriented strand pattern board). It is made of many layers of small wood veneers of the same direction fiber crossly overlapped. Its fiber layers are composed of many small wood veneers having its length (along fiber direction) several times than its width and arranged parallel to one side of the veneers. This OSB, made of many layers of the same direction fiber alternately vertically overlapped board is disclosed at length in an early U.S. Pat. No. 3,164,511 (1965) regarding to its manufacturing processes and property. The advantage of OSB is the property almost similar to natural wood, and adjustable in its size, may have the length as long as 40 feet, and its thickness also possible to be made to order. Furthermore, OSB makes use of material waste produced in wood factories, especially contributive to the environment.

The property and appearance of present OSB have been improved in U.S. patents such as U.S. Pat. No. 4,364,984 (1981), U.S. Pat. No. 5525394 (1995), U.S. Pat. No. 5,736,218 (1998), etc. It has been improved in manufacturing processes, changing the shape of fiber pieces, arrangement, structure and adhesives, and increasing its good appearance, physical property and weather-endurance. But OSB having fire-resistant property has not been developed much, and only U.S. Pat. No. 5,443,894 (1994) offers a fire-resistant OSB having adhesive added with expandable graphite, but there are not any other reports and news about fire-resistant OSB.

Although fire-resistant OSB can be made by means of a traditional vacuum pressure filling method (for example, CNS 300/0101), injecting various fire-resistant chemicals (such as CNS4180/K1195, CNS4181/K1196, CNS4182/K1197, and CNS4183/K1198) in OSB to obtain fire-resistant effect. However, OSB has a loose structure itself so when a water-soluble fire-resistant chemical is injected in it, inflation caused by water forms a great damage to the physical property of OSB, reducing its availability.

SUMMARY OF THE INVENTION

The objective of the invention is to offer a method for manufacturing reinforced oriented strand boards, wherein finished oriented strand boards are made by injecting melamine-formaldehyde resin or phenol-formaldehyde or mixtures of melamine-urea-formaldehyde resins in them by means of a vacuum pressure impregnation processes, and then heated and pressed to harden the resin. As the oriented strand boards have gaps impossible to completely fill up, still many of them remained therein. Therefore, the resin injected therein may fill up the gaps remained therein to infiltrate and wrap the strand board not only to make it fire-resistant, but to improve its whole strength conspicuously.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
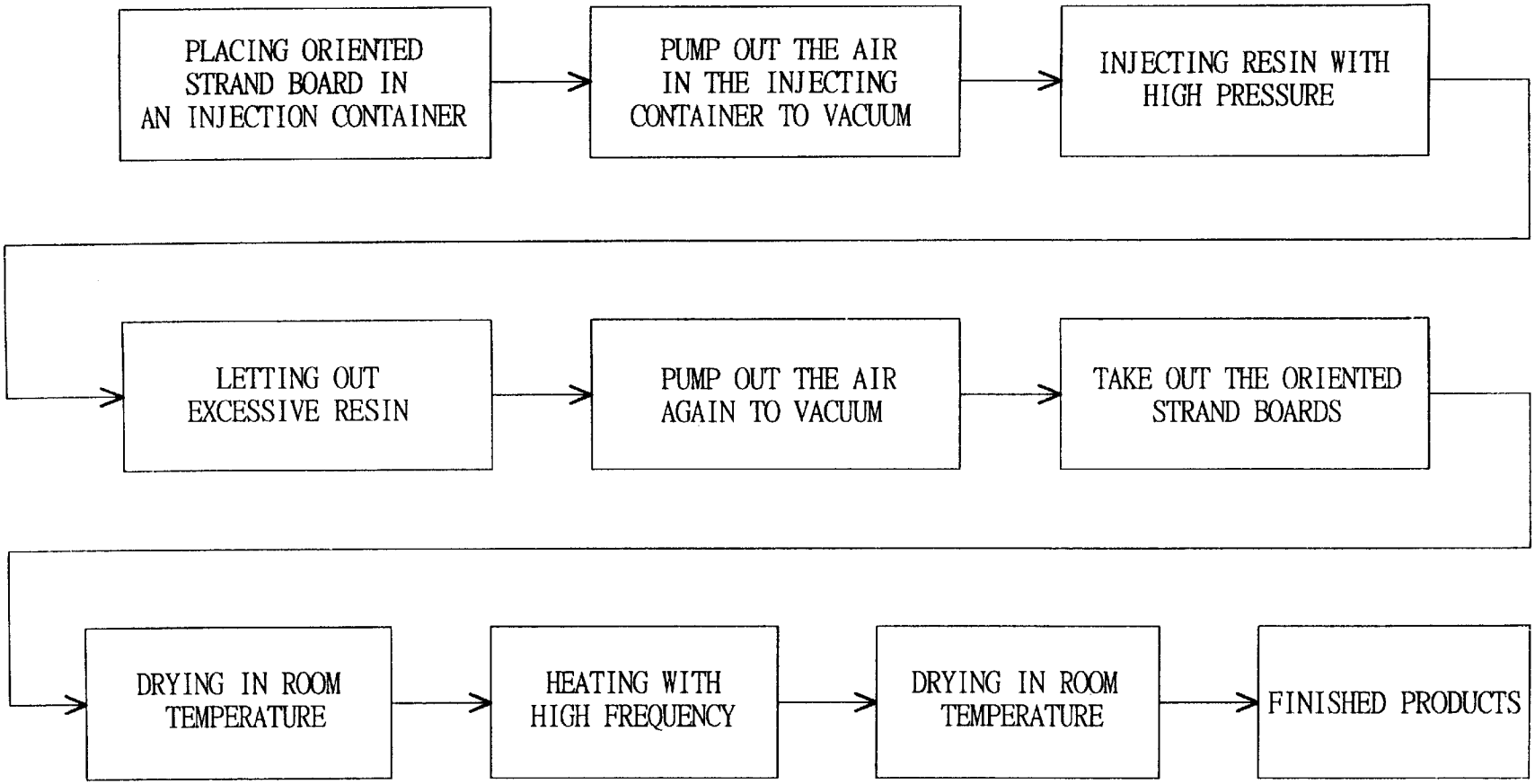
FIG. 1 is a flowing chart of a method for manufacturing reinforced oriented strand boards of the present invention.

First, as shown in FIG. 1, a method for manufacturing reinforced oriented strand boards in the present invention includes a step of injecting melamine-formaldehyde resin (M/F) or phenol-formaldehyde resin (P/F), or melamine-urea-formaldehyde resins M-U/F into an oriented strand board 1 by means of a vacuum pressing process, a next second step of heating and pressing to let resin in the board harden in many gaps remained in the board, as strand woods of the oriented strand board 1 are impossible to be adhered completely, so making use of resin injected in those gaps remained. The liquid resin to be injected contains more than 30% of solid percentage, and injected resin accounts for more than 40% weight of the oriented strand board so that injected resin can fill up the gaps in the board 1 and infiltrate and wrap up the strand woods, making the whole oriented strand board 1 not merely provided with fire-resistant property but improved in adhered strength conspicuously.

Figure 2:
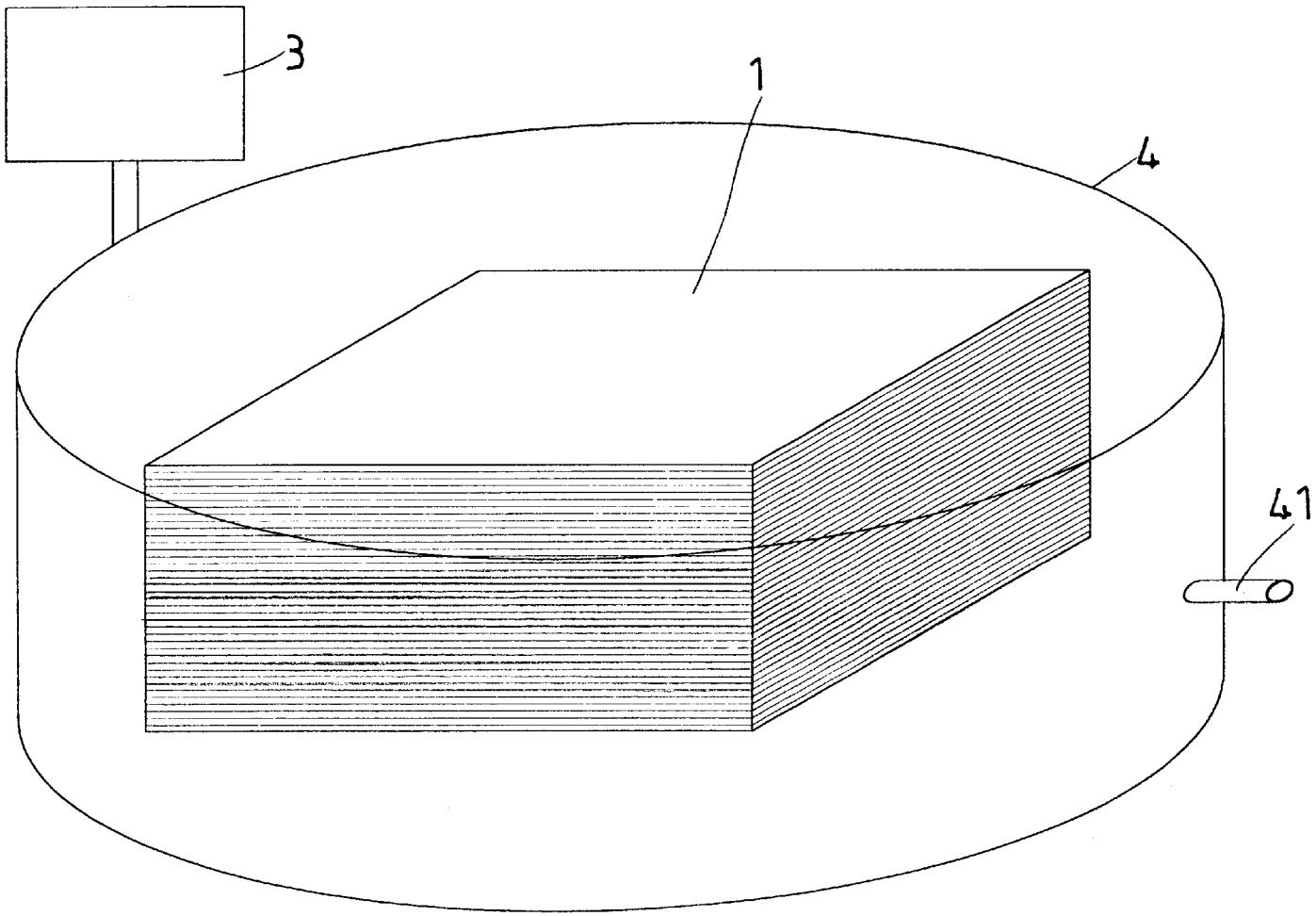
FIG. 2 is a perspective view of a manufacturing process of the present invention.
Figure 3:
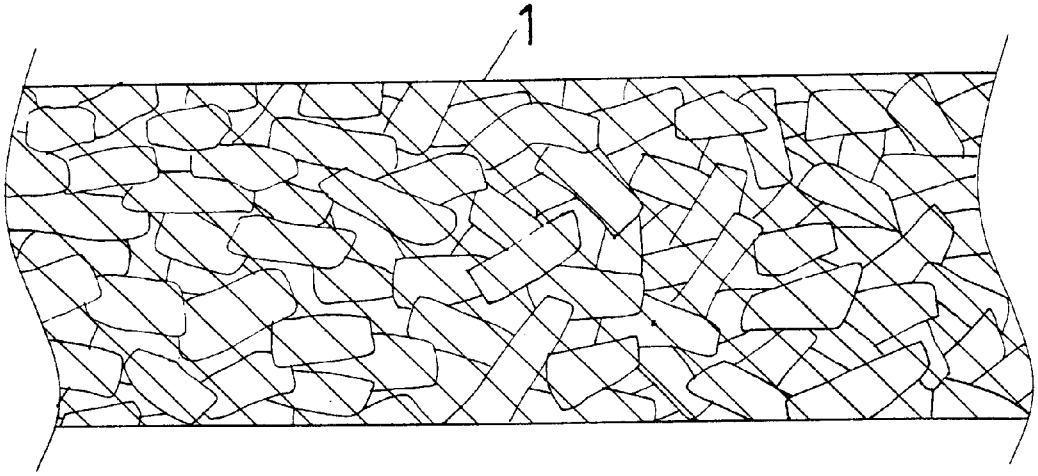
FIG. 3 is a cross-sectional view of an oriented strand board used of the present invention.
Figure 4:
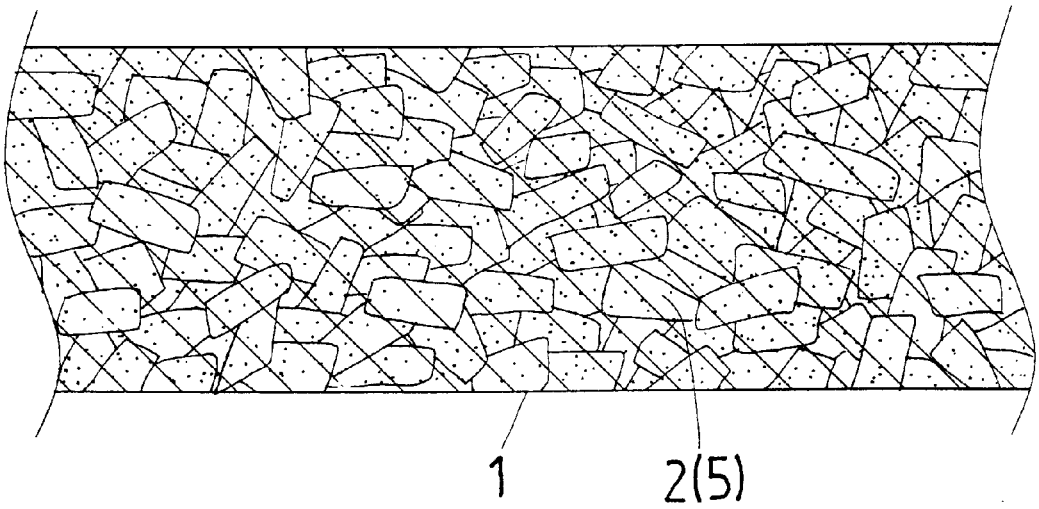
FIG. 4 is a cross-sectional view of an oriented strand board injected with resin hardened of the present invention.

Next, practical manufacturing processes are to be described in detail, with reference to FIGS. 1 and 2.

1. Injecting Melamine-formaldehyde Resin in an Oriented Strand Board.

1-1. Placing 2500 g. of 37% low methanol formaldehyde water solution in a reaction oven. Then adjust pH of 2N NaOH solution to 8–9 and add 1890 g. melamine in the 2N NaOH water solution. Next, the reaction liquid is heated to boil (between 80–95° C.) and kept boiling for 10 minutes or so. Then test water proportion of the reaction liquid (Holland, DSM method). When the water proportion reaches 1–1.5, the reaction liquid is cooled to room temperature and adjust its ph to 9.2–9.4 by adding 2N NaOH. Finally, dilute it with water to become resin having solid proportion 40–55% and control its viscosity to 10–80 cps, but keep the resin liquid clear and transparent. Thus the melamine-formaldehyde resin is made.

In addition, in compounding melamine-formaldehyde resin, mol proportion of melamine and formaldehyde may be between 1:1 and 1:3; compounding materials of melamine-formaldehyde resin is not limited to melamine and formaldehyde, but melamine and urea may be used to mix and then this mixture is polymerized with formaldehyde. Mol proportion of melamine and urea may be between 3:1 and 1:4, and the mixture of melamine with urea and formaldehyde may be between 1:1 and 1:3.

1-2. Inject the melamine-formaldehyde resin 2 obtained in the 1-1 step in the oriented strand board 1 by means of a vacuum pressure impregnation process. First, place the oriented strand board 1 in an impregnation container 4, and then evacuate the air in the container 4 to a vacuum condition of air pressure less than one atmosphere (760 mm-Hg)–3 mm-Hg (preferably 50 mm-Hg). Next, inject resin 2 through the inject inlet 41, and finally increase injecting pressure to 3 $Kg/cm^2$–40 $Kg/cm^2$ (preferably 35 $Kg/cm^2$, and maintain the pressure for at least 30 minutes. Next, let out excessive resin 2 in the impregnation container 4, and evacuate air with vacuum pump to less than one atmosphere (760 mm-Hg)–3 mm-Hg (preferably 50 mm-Hg). Finally, the finished oriented strand board is taken out, and the taken out board 1 has clean surface and the resin liquid remained on its surface is not obvious (not dripping), and the finished boards are weighted.

The following Table 1 shows weight difference of the oriented strand boards 1 before and after injection of melamine formaldehyde resin 2, with 5 boards of different thickness and each is the averaged of two boards (22 cm×22 cm).

TABLE 1

| OSB THICKNESS | WEIGHT BEFORE INJECTION | WEIGHT AFTER INJECTION | RESIN ABSORING PERCENTAGE |
|---|---|---|---|
| 13.5 mm | 385 g | 710 g | 98.3% |
| 16.3 mm | 482 g | 994 g | 95.9% |
| 18.5 mm | 566 g | 1210 g | 113.8% |
| 19.0 mm | 570 g | 1113 g | 95.2% |
| 29.0 mm | 754 g | 1510 g | 100.3% |

The length and width of the oriented strand board 1 changes very little, and the thickness increased about 12% after injection of the resin; in this invention, variables such as water contents of the board 1, viscosity of the resin 2, total solid contents of the resin 2, injecting pressure and injection time, etc. have been proved to have influence on the finished oriented strand board. Generally speaking, water containing percentage and the injecting volume are contrary to each other, the higher the humidity of the boards the less the resin is injected, but the disparity is not large. This may be caused by paraffin wax coated on the surface of the oriented strand board 1 during the manufacturing of the boards to increase moisture-resistance. So resin 2 enters strand wood 11 with comparatively smaller amount, but in gaps 12 between strand woods 11 has larger voids to pick up the resin 2. The lower the viscosity of resin 2 is, the more the resin 2 is injected, and the higher the solid content of the resin liquid 2 is, the more the resin 2 is injected. The optimal volume of resin 2 injected is between 40–50% of solid content, over 55% of solid content of resin 2, the injected quantity does not increase conspicuously. This may have relation with the fact that solid content would increase the viscosity of the resin. In addition, the higher the injecting pressure is, the more the injecting volume is, but became less obvious above 30 $Kg/cm^2$. Injection time and injecting volume have direct relation, the longer the injection time, the more injecting volume is. In all cases the weight of melamine-formaldehyde resin 2 injected in accounts for 30%–120% of the weight of the oriented strand board 2.

1-3. After the oriented strand board had been injected with resin 2, if is dried for 3 days at room temperature, and then heated to 80° C. by means of high frequency (measuring temperature with a remoter infrared temperature defector) to harden resin 2 and then dried for 48 hours at room temperature, the final products is a strength reinforced oriented strand board.

Table 2 showing the weight of an oriented strand board before and after injection of M/F resin and drying.

TABLE 2

| | BEFORE INJECTION | AFTER INJECTION | CHANGE |
|---|---|---|---|
| THICKNESS | 19.0 | 22.0 | +16% |
| WEIGHT | 570 | 744 | +30.4% |
| DENSITY (g/c.c) | 0.620 | 0.698 | +12.6% |
| LENGTH, WIDTH | EXTREMELY LITTLE CHANGE | | |

The wet weight of M/F resin absorbed is 95.2% w/w of the oriented strand board, but after drying its weight increases only 30.4%. The extra 13% weight loss from the theoretical value, maybe accounted for from the loss of the water already presented in the oriented strand board before the injection of resin 2 which evaporated with the heating with high frequency energy.

Next, the oriented strand board 1 after HF dried is weighed and placed in a water tank for 24 hours, taken out, wiped dry the outer surface and weighted, the water absorbability of the resin forced OSB board is calculated to be less than 13%.

TABLE 3

| SAMPLE | WEIGHT BEFORE IMMERSING IN WATER | WEIGHT AFTER IMMERSING IN WATER | WATER ABSORBING PERCENTAGE |
|---|---|---|---|
| 1 | 124 g | 140 g | 12.9% |
| 2 | 523 g | 588 g | 12.4% |

2. Injecting Phenol-formaldehyde Resin into the Oriented Strand Boards.

2-1. Heating 1000 g of phenol in the reaction vessel to 40–50° C., after the phenol is melted, add 167 g of 42% caustic soda solution 10 minutes of reaction, heated the solution to 90–95° C., and maintained at that temperature for 30 minutes, then cooled to room temperature, add water to adjust its viscosity to 20–80 cps for later use (but its solid content should not be less than 30%). That is, the water volume at most should not be more than 80% weight of the reaction liquid (solid content being 55% or so).

2-2. Inject phenol-formaldehyde resin 5 obtained from the process 2-1 in the oriented strand board 1 by means of a vacuum high pressure injecting process. First, place the oriented strand board 1 in an injecting container 4, pump out the air in the container 4 to the vacuum less than one atmosphere (760 mm-Hg)–3 mm-Hg (preferably 50 mm-Hg), then inject resin 5 through an inject inlet 41, and finally elevate injecting pressure of resin 5 to 3 $Kg/cm^2$–40 $Kg/cm^2$ (preferably 35 $Kg/cm^2$), and maintain the pressure at least for 30 minutes, and then let out the excessive resin 5 in the container 4. Next, evacuate the air again to vacuum condition. Finally, the oriented strand board 1 presented.

2-3. Dry the reinforced oriented strand board after P/F resin injection at room temperature for 3 days, then heat to 80° C. (measuring temperature with an infrared temperature detector) to harden resin 5, and then dried it again at room temperature for 48 hours. The final product is a phenol-formaldehyde strength reinforced an oriented strand board.

What is claimed is:

1. A method for manufacturing a reinforced oriented strand board comprising the steps of:

a. placing an oriented strand board in an impregnation container having an injecting inlet;

b. evacuating air from said impregnation container;

c. providing a resin selected from the group consisting of melamine formaldehyde and melamine-urea-formaldehyde;

d. injecting only said resin into said impregnation container through said injecting inlets;

e. adding pressure to said injected resin and maintaining said pressure for 30 minutes to impregnate said oriented strand board;

f. removing excessive resin from said impregnation container;

g. evacuating said impregnation container to less than one atmosphere;

h. removing said impregnated oriented strand board from said impregnation container and drying said impregnated oriented strand board at approximately 20° C. for 3 days;

i. heating said dried oriented strand board to 80° C. to harden said resin; and, j. drying said heated oriented strand board at approximately 20° C. for 48 hours to obtain a strengthened and fire-resistant oriented strand board.

2. The method of claim 1, wherein the step of injecting said resin includes the step of injecting said resin in an amount that is 30–120% of the weight of said oriented strand board.

3. A method for manufacturing a reinforced oriented strand board comprising the steps of:

a. placing an oriented strand board in an impregnation container having an injecting inlet;

b. evacuating air from said impregnation container;

c. providing a phenol-formaldehyde resin and injecting only said phenol-formaldehyde resin into said impregnation container through said injecting inlet;

d. adding pressure to said injected resin and maintaining said pressure for 30 minutes to impregnate said oriented strand board;

e. removing excessive phenol-formaldehyde resin from said container;

f. evacuating said impregnation container;

g. removing said impregnated oriented strand board from said impregnation container;

h. drying said impregnation oriented strand board at approximately 20° C. for 3 days;

i. heating said dried oriented strand board to 80° C. to harden said phenol-formaldehyde resin;

j. drying said heated oriented strand board at approximately 20° C. for 48 hours to obtain a strengthened and fire-resistant oriented strand board.

4. The method of claim 3, wherein the step of injecting said phenol-formaldehyde resin includes the step of injecting said phenol-formaldehyde resin in an amount that is 30–120% of the weight of said oriented strand board.

* * * * *